US005992049A

United States Patent [19]

Trost

[11] Patent Number: 5,992,049

[45] Date of Patent: Nov. 30, 1999

[54] GRAIN MOISTURE REGULATING SYSTEM

[76] Inventor: Gary L. Trost, 1208 S. 9th St., Omaha, Nebr. 68108

[21] Appl. No.: 08/612,800

[22] Filed: Mar. 11, 1996

[51] Int. Cl.[6] ..... F26B 13/10

[52] U.S. Cl. ..... 34/528; 34/531; 34/174; 34/175

[58] Field of Search ..... 34/527, 528, 531, 34/562, 168, 174, 175

[56] References Cited

U.S. PATENT DOCUMENTS

| | | | |
|---|---|---|---|
| 3,503,137 | 3/1970 | Wilson | 34/527 |
| 3,636,638 | 1/1972 | Noyes | 34/174 X |
| 4,035,928 | 7/1977 | Sietmann et al. | 34/174 |
| 5,189,812 | 3/1993 | Ediger | 34/175 X |

*Primary Examiner*—Stephen Gravini
*Assistant Examiner*—Steve Gravini

[57] ABSTRACT

A grain moisture regulating system includes a grain bin with a perforated grain supporting floor and a fan for blowing outside ambient air into the grain bin through the grain mass set thereupon, and through an air outlet at the top of the grain bin. A humidistat fan control system measures ambient moisture in the air outside the grain bin and compares it to ambient moisture in the air inside the grain bin for controlling the fan. A fan operation control system includes a plurality of moisture content sensors which measure ambient moisture in the air outside the grain bin and ambient moisture in the air above the grain mass in the grain bin to produce a signal for the humidistat fan control system. A computer operates to receive input signals from the fan operation control system, wherein a desired ambient moisture threshold level of the grain mass is set into the computer, and when the ambient moisture in outside air exceeds the desired ambient moisture threshold level of the grain mass, the humidistat fan control system stops fan operation, and in the other event, the humidistat fan control system will turn the fan on. Finally, a plurality of timers are included which are setable in timed increments for maintaining power to the fan and are further controlled by the computer for maintaining power to the fan as a function of the desired ambient moisture threshold level of the grain mass.

3 Claims, 2 Drawing Sheets

GRAIN MOISTURE REGULATING SYSTEM

BACKGROUND OF THE INVENTION

1. Technical Field

This invention is in the field of grain drying systems used with grain bins and, more particularly, a grain moisture regulating system employing ambient air blown into the bottom of the bin and moving upwardly through the grain mass when the outside air moisture content is less than the moisture content of the air within the grain bin.

2. Description of the Prior Art

Many examples of grain drying systems are found in the prior art, most of which employ some variation of the following described system. A perforated drying floor is suspended above the floor of the grain bin, and the grain mass rests on the drying floor. Air is directed under the drying floor and upwards through the grain mass by a fan unit or the like. As the directed air passes through the grain mass, the moisture on the outside of the kernels is "wiped off" and removed as the air exits the grain bin at the top thereof. The grain mass is thus slowly dried as air moves over the grain.

The prior art as thus described includes several disadvantages, one of the main ones being that the air used to dry the grain is sent through the grain mass regardless of the moisture content of the air. Clearly, if the air used for drying has a higher moisture content than the grain mass itself (which often occurs in grain-producing areas), the grain mass may actually be remoisturized which is counter-productive to the drying process. There is therefore a need for a drying system which will not operate when the outside moisture content is higher than the moisture content within the grain bin.

Another problem in the storage of grain occurs when grain is stored in the grain bin, the top of the grain mass often forms a dense top cap due to the moisture-bred "stickiness" of the upper grains. This top cap is often so dense that a man can walk on the top cap without his legs sinking into the top of the grain much beyond his shoe tops. In the prior art, when the fan is on, pressurized, moisture-laden air hits the empty void at the top of the bin above the grain mass, and there much of the moisture in the air falls back down when that air exits the bin exit ports because the ports release the air too quickly and the pressure at the top of the bin is too low. The result is an "air-stall".

Such an "air-stall" lets moisture be "rained" back out of the air mass which falls down onto the grain, clogging its air-flow and causing its top cap to get still more dense from expanded, moisture swollen kernels. The system hereof prevents much of the air stalling and "raining back" due to the generally continuous air flow under relative high pressure through the grain mass during the drying process. Such a process gives more drying opportunity for grain within the grain bin than those processes found in the prior art.

Drying efficiency in many prior art systems is decreased by static pressure, which in terms of the grain mass results from two major conditions. One involves the blocking of airflow by moistureswollen kernels, and the other involves air flow blockage by the tightly packed together kernels in the top cap.

Other prior art devices stir the dense top crust or top cap in grain bins by a mechanism sometimes called a "stir-ator". Such "stir-ators" can be quite expensive. There is therefore a need for a system which will act to substantially prevent formation of the top cap of the grain mass with or without a "stir-ator" unit being present.

One of the problems encountered in the prior art is that although some prior art systems determine the external humidity and others determine the internal humidity, there is no example in the prior art that discloses a system that will compare the external moisture content of the air to the internal moisture content and prevent fan operation for drying unless the external moisture content of the air is less than the internal moisture content. There is a need for such a system.

Another problem encountered in the prior art is that many of the drying systems presently being used steadily force relatively low volumes of air through the high moisture grain mass which can result in the redepositing of moisture on the top of the grain mass, the moisture that has been removed from the grain mass by the passage of air therethrough. As the warmed moisture-laden air travels upward through the grain and enters the upper region of the grain bin above the grain mass, unless there is sufficient air volume moving upwards through the grain mass, the moisture-laden air at the top of the grain bin is not forced out of the eave air outlets before it cools. As the air cools, it no longer can hold the same volume of moisture and some of the moisture will then recondense and fall out of the air on to the top of the grain mass. This can result in the formation of the top cap, which further acts to prevent drying of the grain mass. Such a condition can be prevented by moving larger masses of air through the grain mass. There is therefore a need for a drying system which will move greater amounts of air through the grain mass and prevent recondensation of water vapor from the air at the top of the grain bin.

SUMMARY OF THE INVENTION

The present invention provides a grain moisture regulating system which includes a grain bin with a perforated grain supporting floor and a fan for blowing outside ambient air into the grain bin in a path from beneath the perforated grain supporting floor, through a grain mass set upon the grain supporting floor which is stored in the grain bin, and through an air outlet at the top of the grain bin. A humidistat fan control system measures ambient moisture in the air outside the grain bin and compares it to ambient moisture in the air inside the grain bin for controlling the fan. A fan operation control system is defined by a plurality of moisture content sensors which measure ambient moisture in the air outside the grain bin along with measuring the moisture in the air above the grain mass in the grain bin to produce a signal for the humidistat fan control system. A computer which receives input signals from the fan operation control system, wherein a desired ambient moisture threshold level of the grain mass is set into the computer, and when the ambient moisture in the air outside the grain bin exceeds the desired ambient moisture threshold level of the grain mass, the humidistat fan control system will turn the fan off and prevent greater than the desired ambient moisture from blowing through the grain mass, and when the ambient moisture in the air outside the grain bin is lower than the desired ambient moisture threshold level of the grain mass, the humidistat fan control system will turn the fan on, and allow drier air to blow through the grain mass. Finally, a plurality of timers are included in the invention which are setable in hourly increments for maintaining continuous power to the fan and further controlled by the computer for maintaining power to the fan as a function of the desired ambient moisture threshold level of the grain mass.

DESCRIPTION OF THE PREFERRED EMBODIMENT

Figure 1:
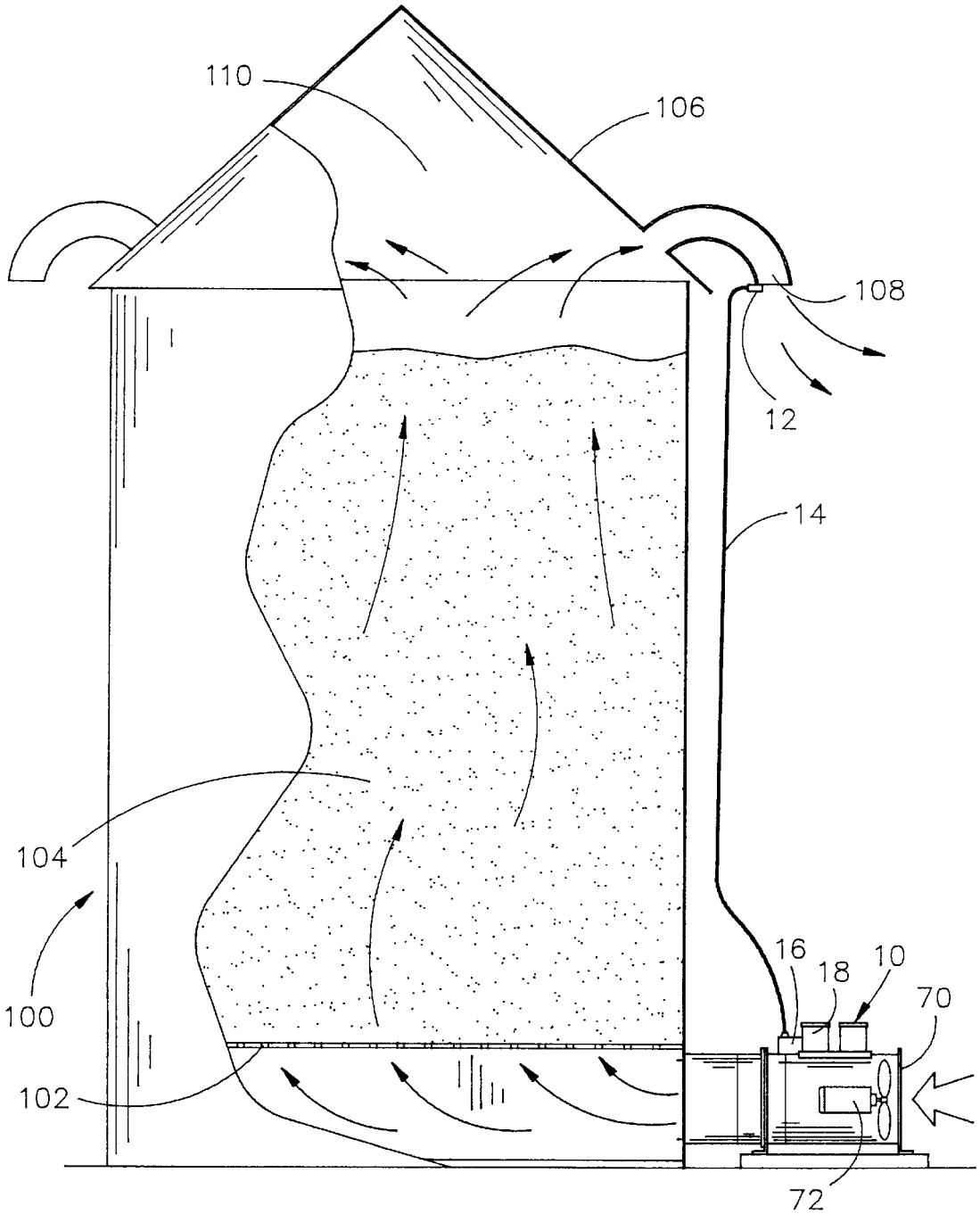
FIG. 1 is a side elevational cutaway view showing the present invention installed on a grain bin and drying grain stored therein.

The grain moisture regulating system 10 of the present invention is shown in FIG. 1 as being fitted onto a grain bin 100 having a perforated grain support floor 102 on top of which is the grain mass 104. The grain bin 100 further includes a roof 106 having at least one air outlet 108 formed on the side thereof for releasing air from the interior of the grain bin 100.

Mounted in the upper area of the grain bin 100 is a moisture content sensor 12. In FIG. 1, the sensor 12 is shown as being mounted in the air outlet 108, but it is to be understood that the sensor can be mounted anywhere above the grain mass 104 so long as the sensor 12 can read the moisture content of the air within the grain bin 100. The sensor 12 is connected in data transmission connection by a wire 14 to a computer 16 which is programmed as will be discussed later in this disclosure. The computer 16 is also connected in data transmission connection to an external air moisture content sensor 18.

As in other drying devices, the present invention includes a blower unit 70 which includes at least one fan 72 for forcing external air into the grain bin 100 underneath the perforated grain support floor 102 and upwards through the grain mass 104. It is preferred that the blower unit 70 be of sufficient strength to force large volumes of air upwards through the grain mass 104, which will of course vary with the size of the grain bin 100. Power to the blower unit 70 is controlled by the computer 16, which as a first operating criteria compares the external air moisture content to the internal air moisture content as follows.

The computer 16 is programmed to obtain a reading of the moisture content of the grain mass 104, and specifically the moisture content of the air mass 110 above the grain mass 104. The computer 16 also is programmed to obtain a reading of the moisture content of the outside air via the external air moisture content sensor 18. If the external air moisture content is lower than the internal air moisture content, the computer 16 signals the blower unit 70 to operate by permitting power to flow to the blower unit 70, provided that further operating criteria are met, which will be outlined later in this disclosure.

Figure 2:
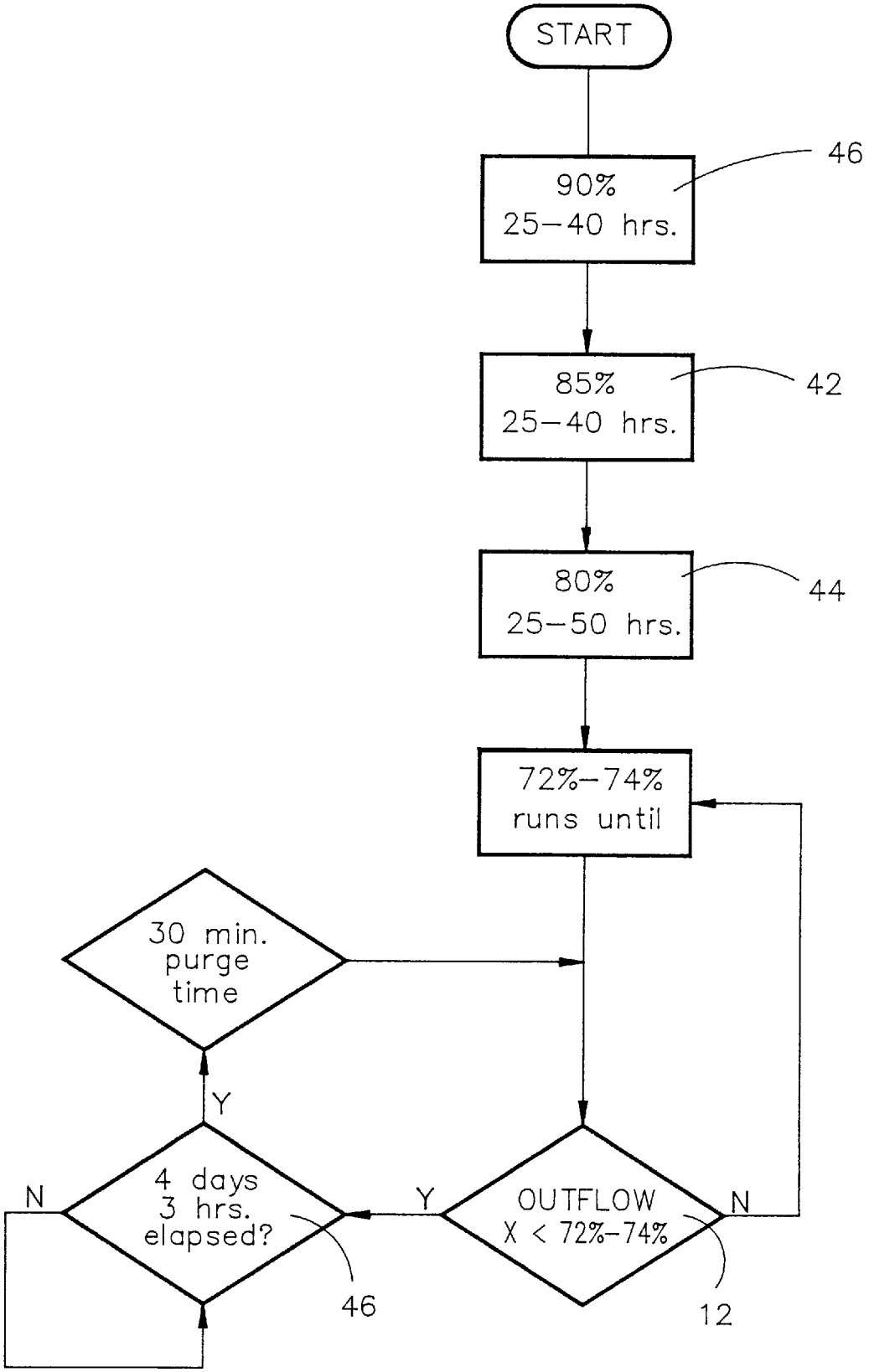
FIG. 2 is a flow chart showing the timed operation of one of the embodiments of the present invention.

The preferred embodiment of the present invention further includes three timer switches 40, 42 and 44, shown as the boxes in FIG. 2, each of which are operatively connected to the computer 16 and which are programmed to operate the blower unit 70 in staged drying times. The first timer is set to run for approximately 25 to 40 hours, and operates to engage the blower unit 70 for that entire time period, sending external air through the grain mass 104 and drying the grain stored in the grain bin 100. Each of the timer switches 40, 42 and 44 is controlled by the computer to operate so long as the external air moisture content is less than a preset level, and if the external air moisture content is higher than that preset level, the computer will stop the timer within the timer switch 40, 42 and 44 and thus cause the blower unit 70 to stop running. When the external air moisture content is again less than that preset level, the computer 16 resumes the timer switch countdown and the blower unit 70 resumes blowing air through the grain mass. Each of the timer switches 40, 42 and 44 work in this manner, and are each independently setable regarding both length of drying time and preset external air moisture content cutoff level. As shown in FIG. 2, it is preferred that timer switch 40 be set to operate the blower unit 70 for approximately 25–40 hours as long as the moisture content of the external air is less than 90%. After timer switch 40 runs, timer switch 42 is then engaged, and it is preferred that timer switch 42 be set to operate the blower unit 70 for approximately 25–40 hours as long as the moisture content of the external air is less than 85%. Lastly, after timer switch 42 runs, timer switch 44 is then engaged, and it is preferred that timer switch 44 be set to operate the blower unit 70 for approximately 25–50 hours as long as the moisture content of the external air is less than 80%. The three timer switches 40, 42 and 44 operate to initially dry the grain within the grain bin, thus bringing the overall moisture content of the grain down from upwards of 18% to 20% towards the desired range of 15%–16%.

Once timer switch 44 has run out, the computer 16 then is programmed to run the blower unit 70 until the moisture content sensor 12 returns a reading of less than a preset moisture content, which in the preferred embodiment would be approximately 72% to 74%. The length of time needed to dry the grain to that moisture content level will vary with the external air moisture content and with the type of grain being dried, but it is expected that such drying would take between 25 and 50 hours. Once the moisture content sensor 12 returns a reading below the preset moisture content level, the computer 16 signals the blower unit 70 to turn off, and the computer 16 initiates a fourth timer 46 that is set, in the preferred embodiment, to time out in approximately four (4) days and three (3) hours. Upon timer 46 timing out, the computer 16 is signaled and in turn engages the blower unit 70 for approximately thirty (30) minutes, which acts as a "purge", driving air through the grain mass and obtaining an accurate moisture content reading from the moisture content sensor 12. It is important that the purge be performed prior to the computer 16 comparing the internal moisture content reading obtained from moisture content sensor 12 to the preset moisture content level (i.e. 72% to 74%) in order to obtain an accurate reading. Moisture levels can build at the top of the grain mass, and this moisture-laden air mass must be removed prior to the reading being taken.

If the moisture content sensor 12 returns a reading higher than the preset moisture content setting, the computer 16 is programmed to engage the blower unit 70 and keep the unit running until the moisture content reading from moisture content sensor 12 is below the preset moisture content setting programmed into the computer 16. At that time, the computer shuts the blower unit 70 and starts timer 46 running again. In this manner, the moisture content of the grain within the grain bin is maintained at a generally constant preset level.

It is to be understood that there are numerous types of timing devices and computing devices that may be substituted for the timers and computers described herein, all of which would be understood by one skilled in the art of such devices. Therefore, the present description is not intended to be limiting in any way, other than those limitations imposed by the claims contained herein.

There has thus been set forth and described a grain moisture regulating system which accomplishes at least all of the objectives set forth herein.

I claim:

1. A grain moisture regulating system comprising:

a grain bin having grain bin airflow means operative to force external air through grain stored within said grain bin;

a fan for blowing outside ambient air into said grain bin in a path from beneath a grain mass stored within said grain bin, through said grain mass stored in said grain bin, and through an air outlet at the top of said grain bin;

a humidistat fan control system which measures ambient moisture in the air outside said grain bin and compares it to ambient moisture in the air inside said grain bin for controlling said fan;

a fan operation control system defined by a plurality of humidity sensors which measure ambient moisture in the air outside said grain bin along with measuring the moisture in the air above the grain mass within the grain bin to produce a signal for said humidistat fan control system;

a computer which receives input signals from said fan operation control system, wherein a desired ambient moisture threshold level of said grain mass is set into said computer, and when the amount of ambient moisture in the air outside said grain bin exceeds said desired ambient moisture threshold level of said grain mass, said humidistat fan control system will turn said fan off, and prevent greater than the desired ambient moisture from blowing through said grain mass, and when the amount of ambient moisture in the air outside said grain bin is lower than said desired ambient moisture threshold level of said grain mass, said humidistat fan control system will turn said fan on, and allow drier air to blow through said grain mass; and a plurality of timers setable in timed increments for maintaining generally continuous power to said fan and further controlled by said computer for maintaining power to said fan as a function of said desired ambient moisture threshold level of said grain mass.

2. The grain moisture regulating system of claim 1 wherein said grain bin further comprises a perforated grain support floor upon which said grain mass rests.

3. The grain moisture regulating system of claim 2 wherein said fan for blowing outside ambient air into said grain bin blows air in a path from the top of said grain bin downwardly through said grain mass set upon said perforated grain supporting floor which is stored in said grain bin, and through an air outlet at the bottom of said grain bin.

* * * * *